US011852347B2

(12) United States Patent
Yun et al.

(10) Patent No.: US 11,852,347 B2
(45) Date of Patent: Dec. 26, 2023

(54) COOKING APPLIANCE HAVING COOLING SYSTEM

(71) Applicant: Samsung Electronics Co., Ltd., Suwon-si (KR)

(72) Inventors: Minho Yun, Suwon-si (KR); Taehun Kim, Suwon-si (KR); Hyunsang Kim, Suwon-si (KR); Sungsoo Park, Suwon-si (KR); Sangil Hyun, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 169 days.

(21) Appl. No.: 16/712,008

(22) Filed: Dec. 12, 2019

(65) Prior Publication Data

US 2020/0191406 A1 Jun. 18, 2020

(30) Foreign Application Priority Data

Dec. 13, 2018 (KR) ..... 10-2018-0160584

(51) Int. Cl.
*F24C 15/00* (2006.01)
*F24C 15/10* (2006.01)
*F24C 15/32* (2006.01)

(52) U.S. Cl.
CPC ..... *F24C 15/006* (2013.01); *F24C 15/101* (2013.01); *F24C 15/102* (2013.01); *F24C 15/322* (2013.01)

(58) Field of Classification Search
CPC .... F24C 15/006; F24C 15/322; F24C 15/102; F24C 15/101; F24C 15/025; F24C 7/067;
(Continued)

(56) References Cited

U.S. PATENT DOCUMENTS 3,889,100 A * 6/1975 Dills ..... F24C 15/006 219/393
6,234,161 B1 * 5/2001 Levi ..... F24C 15/006 126/19 R
(Continued)

FOREIGN PATENT DOCUMENTS

DE 296 02 780 U1 6/1997
FR 2 726 633 A1 5/1996
(Continued)

OTHER PUBLICATIONS

Bordas et al., Bordas FR2726633 translation, 1996 (Year: 1996).*
(Continued)

*Primary Examiner* — Jason Lau
(74) *Attorney, Agent, or Firm* — STAAS & HALSEY LLP

(57) ABSTRACT

A cooking appliance having a cooling system includes an oven; a cooktop provided at an upper side of the oven; an electrical component disposed in a front surface of the cooktop; a first cooling duct provided between a top surface of the oven and a bottom surface of the cooktop to communicate with a first suction port in a front surface of the oven; an exhaust duct disposed in a rear surface of the cooktop and connected to a rear end of the first cooling duct; a second cooling duct communicating with a second suction port in the front surface of the cooktop and provided inside the cooktop; and an exhaust fan disposed in a connecting section between the first cooling duct and the exhaust duct, wherein the second cooling duct is connected to the first cooling duct in a position closer to the exhaust duct than the electrical component.

15 Claims, 15 Drawing Sheets

(58) Field of Classification Search
CPC .. F24C 7/085; F24C 15/2007; F24C 15/2042; F24C 12/006; F24C 3/126; F24C 7/082; F24C 15/02; F24C 15/08; F24C 3/124; F24F 2007/001; A21B 1/40
USPC ..... 126/21 A, 198
See application file for complete search history.

(56) References Cited

U.S. PATENT DOCUMENTS

| | | | | |
|---|---|---|---|---|
| 9,513,015 | B2 * | 12/2016 | Estrella | F24C 7/085 |
| 9,696,042 | B2 * | 7/2017 | Hasslberger | F24C 15/006 |
| 10,024,547 | B2 | 7/2018 | Johnson et al. | |
| 2008/0184985 | A1 | 8/2008 | Hasslberger et al. | |
| 2012/0305544 | A1 | 12/2012 | Oagley et al. | |
| 2014/0150771 | A1 | 6/2014 | Gayle et al. | |
| 2015/0241069 | A1 | 8/2015 | Brant et al. | |
| 2015/0323196 | A1 | 11/2015 | Chadwick et al. | |
| 2015/0369491 | A1 | 12/2015 | Estrella et al. | |
| 2016/0209051 | A1 | 7/2016 | Na | |
| 2018/0245797 | A1 | 8/2018 | Johnson | |
| 2018/0340694 | A1 * | 11/2018 | Greenbaum | F24C 15/006 |
| 2019/0260915 | A1 * | 8/2019 | Armstrong | F27B 5/18 |

FOREIGN PATENT DOCUMENTS

| | | | | |
|---|---|---|---|---|
| FR | 2726633 | A1 * | 5/1996 | F24C 15/006 |
| KR | 10-2009-0063421 | A | 6/2009 | |
| KR | 10-2009-0082333 | | 7/2009 | |

OTHER PUBLICATIONS

International Search Report and Written Opinion of the International Searching Authority dated Mar. 17, 2020 in International Patent Application No. PCT/KR2019/017303.
European Extended Search Report for European Patent Application No. 19897508.8 dated Oct. 14, 2021.
Korean Office Action dated Nov. 29, 2022 in Korean Patent Application No. 10-2018-0160584 (7 pages; 8 pages English translation).
Office Action dated Jun. 13, 2023 in European Patent Application No. 19 897 508.8.

* cited by examiner

COOKING APPLIANCE HAVING COOLING SYSTEM

CROSS-REFERENCE TO RELATED APPLICATION(S)

This application is based on and claims priority under 35 U.S.C. § 119 to Korean Patent Application No. 10-2018-0160584, filed on Dec. 13, 2018, in the Korean Intellectual Property Office, the disclosure of which is incorporated by reference herein in its entirety.

BACKGROUND

1. Field

The disclosure relates to a cooking appliance such as an oven range, and more particularly to a cooking appliance having a cooling system.

2. Description of the Related Art

An oven range having an oven provided in the lower side thereof and a cooktop provided in the upper side thereof is widely used as a cooking appliance.

Such an oven range is equipped with a cooling system as illustrated in FIG. 1 in order to prevent the outside surface of the oven from being overheated by the heat generated when the oven is operated.

Referring to FIG. 1, a conventional oven range 100 is provided with a cooling passage 106 for cooling the outer surface of the oven 101 around the cooking chamber 102 of the oven 101. In detail, the cooling passage 106 is provided along the inside of the door 104 and the top, rear, and bottom surfaces of the cooking chamber 102 of the oven 101. A cooktop 110 is provided above the cooling passage 106 provided on the top surface of the oven 101. In addition, the cooling passage 106 is provided with a fan motor 107 capable of sucking outside cold air into the cooling passage 106.

Therefore, when the fan motor 107 is operated, outside cold air (arrow A) is sucked into the cooling passage 106 through a suction port 105 provided at the lower end of the door 104, passes through the inside of the door 104 and the top, rear, and bottom surfaces of the cooking chamber 102, and then is discharged to the outside of the conventional oven range 100. In this way, the outside surface of the oven 101 is cooled by the outside cold air traveling along the cooling passage 106 provided on the outer surface of the cooking chamber 102.

However, in the case of the conventional oven range 100, the cooktop 110 provided in the upper side is not provided with the cooling system. Therefore, when cooking by operating the cooktop 110, the temperature of the inside of the cooktop 110 is increased by the radiant heat of a burner 111.

Accordingly, it is common not to dispose electrical components, such as processors, displays, and the like that are vulnerable to high temperature inside the cooktop 110.

However, it is necessary to provide electrical components such as a processor, a display, and the like inside the cooktop 110 of the oven range 100 according to a user's request. Therefore, it is necessary to cool the inside of the cooktop 110 so that the electrical components may be disposed in the cooktop 110 of the oven range 100.

SUMMARY

Additional aspects will be set forth in part in the description which follows and, in part, will be apparent from the description, or may be learned by practice of the presented embodiments.

The present disclosure has been developed in order to overcome the above drawbacks and other problems associated with the conventional arrangement. An aspect of the present disclosure relates a cooking appliance having a cooling system that can cool the outside of the oven and electrical components disposed inside the cooktop.

According to an aspect of the present disclosure, a cooking appliance having a cooling system may include an oven having a cooking chamber therein; a cooktop provided at an upper side of the oven; a first electrical component disposed in a front surface of the cooktop; a first cooling duct provided between a top surface of the oven and a bottom surface of the cooktop and configured to communicate with a first suction port formed in a front surface of the oven; an exhaust duct disposed in a rear surface of the cooktop and connected to a rear end of the first cooling duct; a second cooling duct configured to communicate with a second suction port formed in the front surface of the cooktop above the first electrical component, the second cooling duct provided inside the cooktop; and an exhaust fan disposed in a connecting section between the first cooling duct and the exhaust duct and configured to suck outside air, wherein the second cooling duct may be connected to the first cooling duct in a position closer to the exhaust duct than the first electrical component.

When the exhaust fan is operated, outside air may be sucked into the second cooling duct through the second suction port, may cool the first electrical component, and then may be discharged to an outside of the cooktop through the first cooling duct and the exhaust duct.

The bottom surface of the cooktop may be spaced apart from the first cooling duct, and a connection duct may be provided between the second cooling duct and the first cooling duct to connect the first cooling duct and the second cooling duct perpendicular to the bottom surface of the cooktop.

The cooking appliance having a cooling system may include a second electrical component disposed on the bottom surface of the cooktop, wherein the second cooling duct may be connected to the first cooling duct between the second electrical component and the exhaust duct.

The first electrical component may be disposed at a center of an inner surface of the front surface of the cooktop, and the bottom surface of the cooktop may be provided with a receiving portion in which the second electrical component is disposed and an outlet through which air is discharged.

The first electrical component may include a display configured to display a state of the cooking appliance, and the second electrical component may include a printed circuit board on which a processor configured to control the cooking appliance is disposed.

The second cooling duct may be formed of the front surface, the rear surface, a top surface, the bottom surface, and both side surfaces of the cooktop, and the bottom surface of the cooktop may be provided with an outlet through which the outside air sucked into the second suction port is discharged.

A top surface of the first cooling duct may be provided with a communication port communicating with the connection duct.

The first cooling duct may include a first duct section that is gradually narrower in width than the first suction port and a second duct section that is connected to the first duct section, is gradually higher in height than the first duct section, and is connected to the exhaust fan, and the second cooling duct may be connected to the second duct section.

The cooking appliance having a cooling system may include a door provided to open and close the cooking chamber in the front surface of the oven; and a door air passage provided inside the door to communicate with the first cooling duct, wherein a lower end of the door air passage may be opened to an outside.

When the exhaust fan is operated, outside air is sucked into the first suction port of the first cooling duct, the second suction port of the second cooling duct, and the lower end of the door air passage. The outside air sucked into the first suction port may cool the top surface of the oven while passing through the first cooling duct and is discharged to the outside through the exhaust duct, the outside air sucked into the second suction port may cool the first electrical component, is introduced into the first cooling duct, and is discharged to the outside through the exhaust duct, and the outside air sucked into the lower end of the door air passage may cool the door, is introduced into the first cooling duct, and then is discharged to the outside through the exhaust duct.

According to an aspect of the present disclosure, a cooking appliance having a cooling system may include an oven having a cooking chamber therein; a cooktop provided at an upper side of the oven; a first electrical component disposed in a front surface of the cooktop; a second electrical component disposed on a bottom surface of the cooktop; a first cooling duct provided between a top surface of the oven and the bottom surface of the cooktop and configured to communicate with a first suction port formed in a front surface of the oven; an exhaust duct disposed in a rear surface of the cooktop and connected to a rear end of the first cooling duct; a second cooling duct configured to communicate with a second suction port formed in the front surface of the cooktop above the first electrical component, the second cooling duct provided inside the cooktop; and an exhaust fan disposed in a connecting section between the first cooling duct and the exhaust duct, wherein the second cooling duct may be connected to the first cooling duct between the second electrical component and the exhaust duct.

The cooking appliance having a cooling system according to an embodiment of the present disclosure having the structure as described above may cool the inside of the cooktop through a cooling duct provided in the cooktop, so that electrical components may be disposed inside the cooktop.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
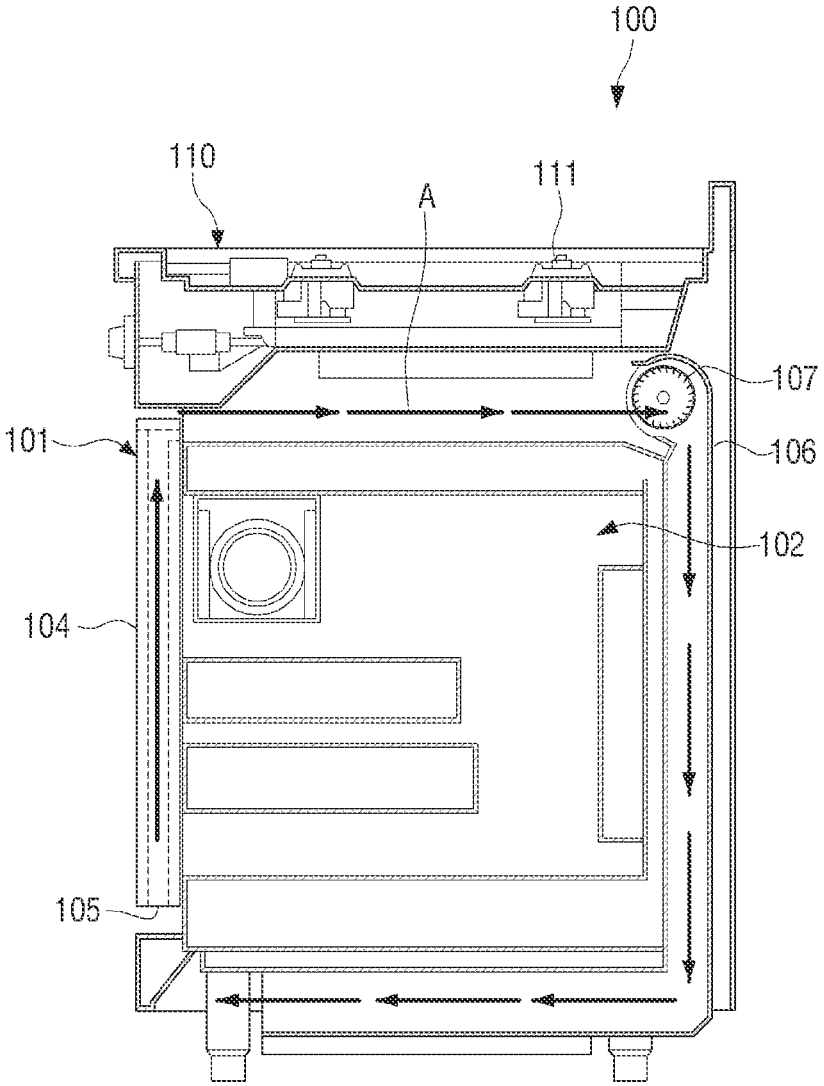
Related Art FIG. 1
FIG. 1 is a cross-sectional view illustrating a conventional cooking appliance.

Hereinafter, various embodiments of the present disclosure will be described in detail with reference to the accompanying drawings.

It should be understood that the disclosure is not limited to the example embodiments described hereinafter, but includes various modifications, equivalents, and/or alternatives of the examples of the disclosure. In relation to explanation of the drawings, similar drawing reference numerals may be used for similar constituent elements. Further, dimensions of various elements in the accompanying drawings may be arbitrarily increased or decreased for assisting in a comprehensive understanding.

In the disclosure, the terms "first, second, and so forth" are used to describe diverse elements regardless of their order and/or importance and to discriminate one element from other elements, but are not limited to the corresponding elements. For example, a first user appliance and a second user appliance may indicate different user appliances regardless of their order or importance. For example, without departing from the scope of the disclosure, the first element may be called the second element, and the second element may be called the first element in a similar manner.

The terms used in the disclosure are used to merely describe various examples, but is not intended to limit the scope of other examples. In the disclosure, a singular expression may include a plural expression unless specially described. All terms (including technical and scientific terms) used in the disclosure could be used as commonly understood by those ordinary skilled in the art to which the disclosure belongs. The terms that are used in the disclosure and are defined in a general dictionary may be used as meanings that are identical or similar to the meanings of the terms from the context of the related art, and they are not interpreted ideally or excessively unless they have been clearly and specially defined. Even the wordings that are defined in the present disclosure must not be interpreted to exclude all examples of the disclosure.

Hereinafter, a cooking appliance having a cooling system according to an embodiment of the present disclosure will be described in detail with reference to the accompanying drawings.

Figure 2:
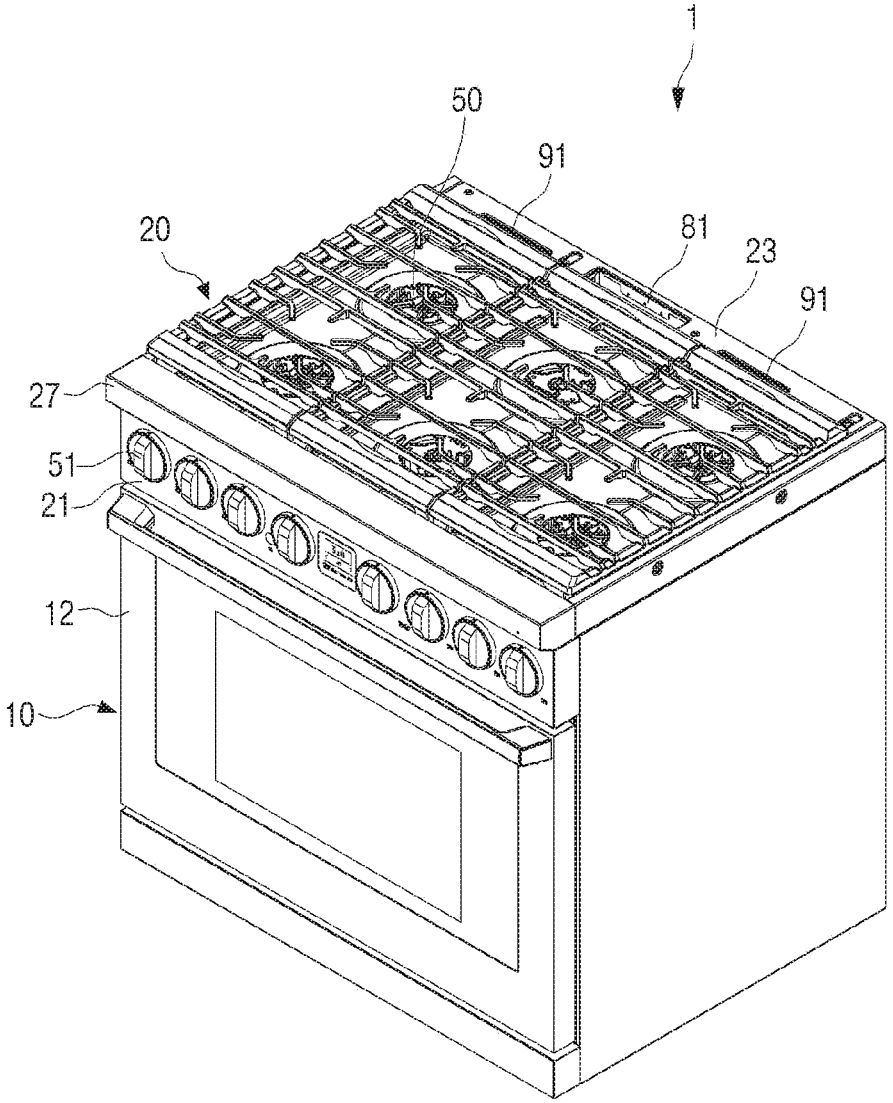
FIG. 2 is a perspective view illustrating a cooking appliance having a cooling system according to an embodiment of the present disclosure.
Figure 3:
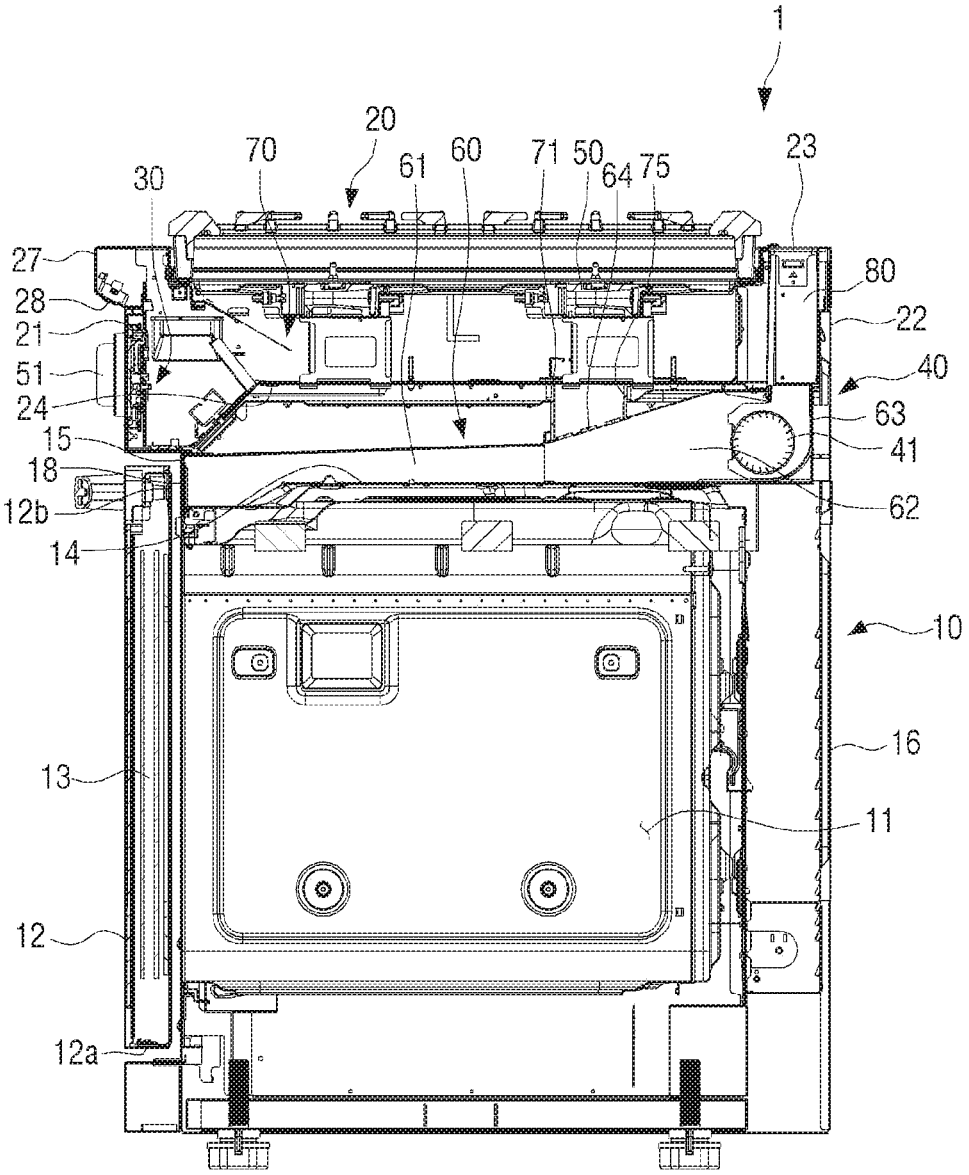
FIG. 3 is a cross-sectional view illustrating a cooking appliance having a cooling system according to an embodiment of the present disclosure.
Figure 4:
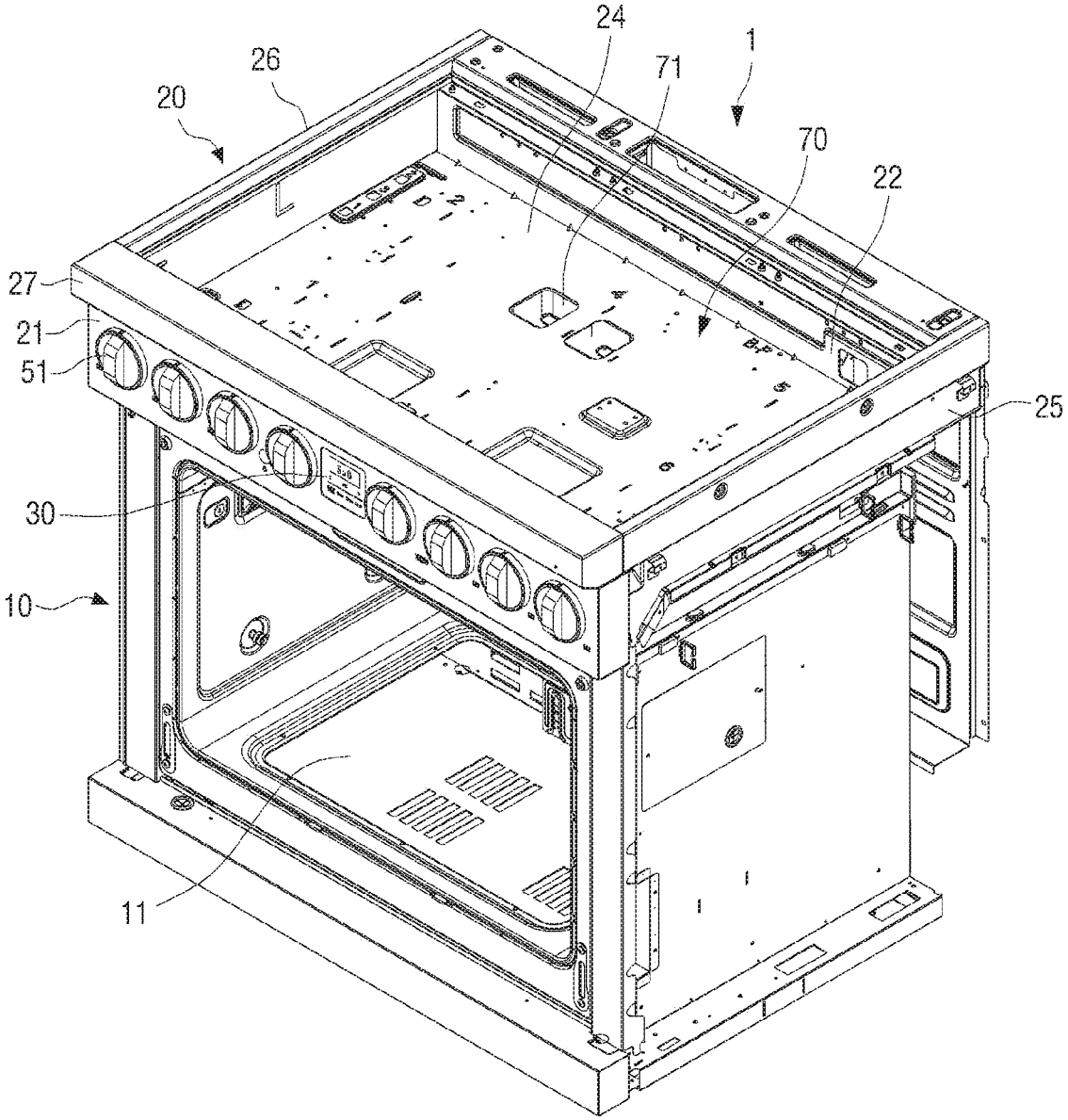
FIG. 4 is a perspective view illustrating an inside of a cooktop of the cooking appliance having a cooling system FIG. 2.
Figure 5:
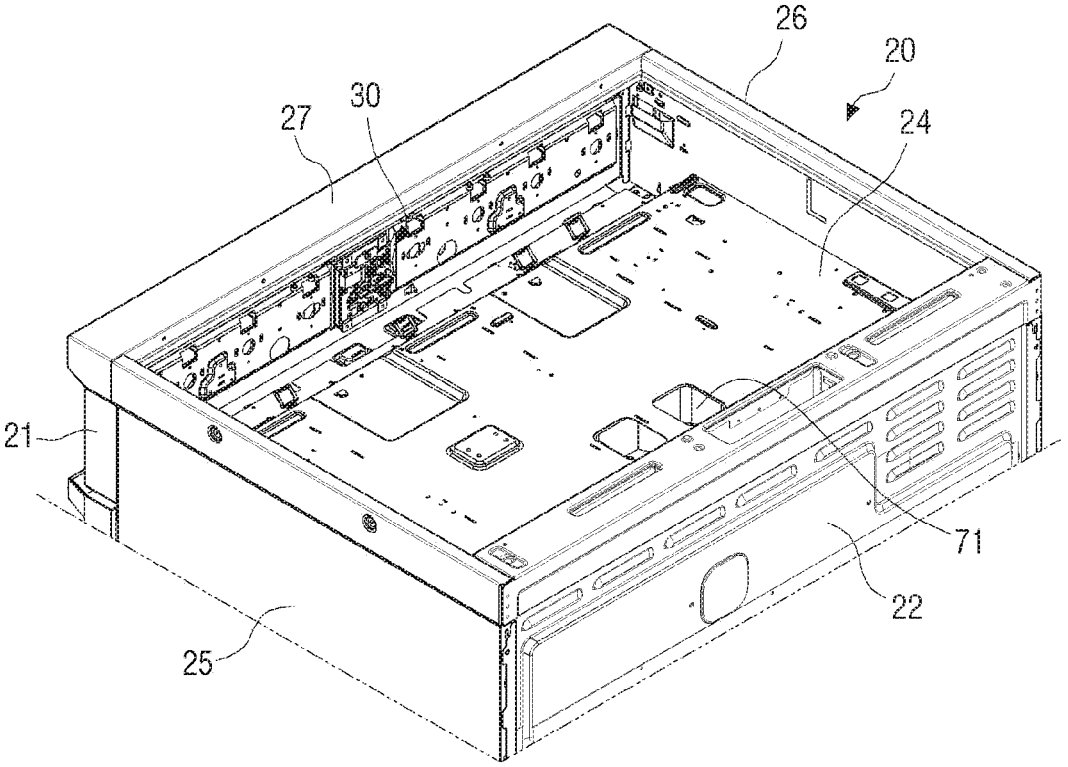
FIG. 5 is a rear perspective view illustrating an inside of a cooktop of the cooking appliance having a cooling system FIG. 2.
Figure 6:
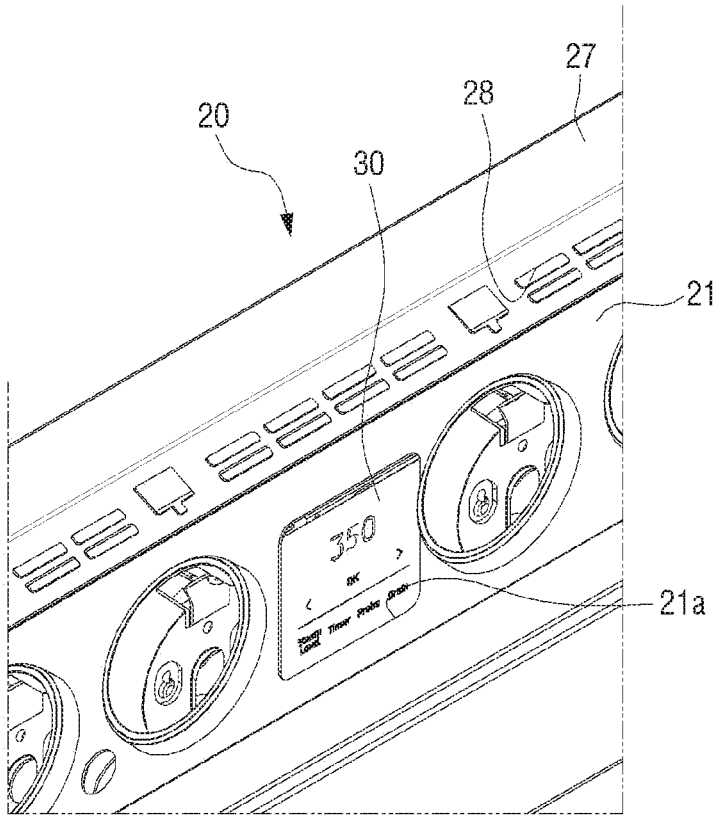
FIG. 6 is a partial perspective view illustrating a second suction port of a second cooling duct of the cooking appliance having a cooling system of FIG. 2.
Figure 7:
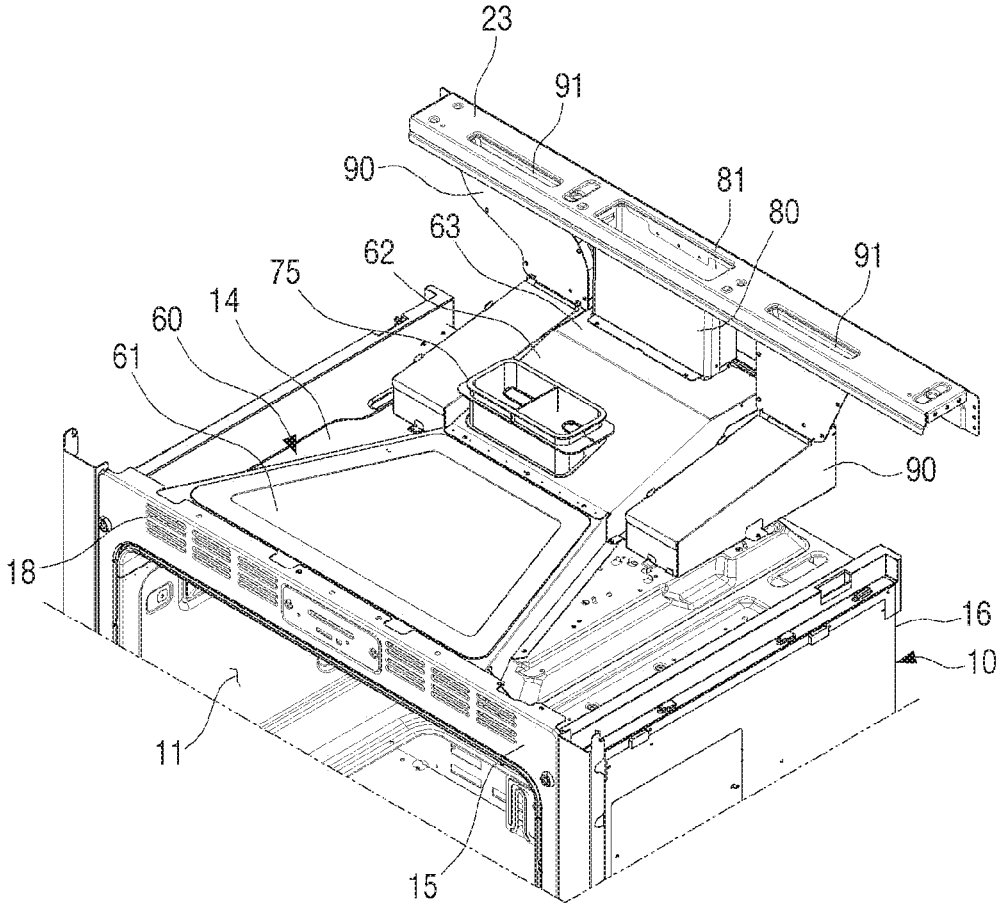
FIG. 7 is a perspective view illustrating a first cooling duct and an exhaust duct of the cooking appliance having a cooling system of FIG. 2.
Figure 8:
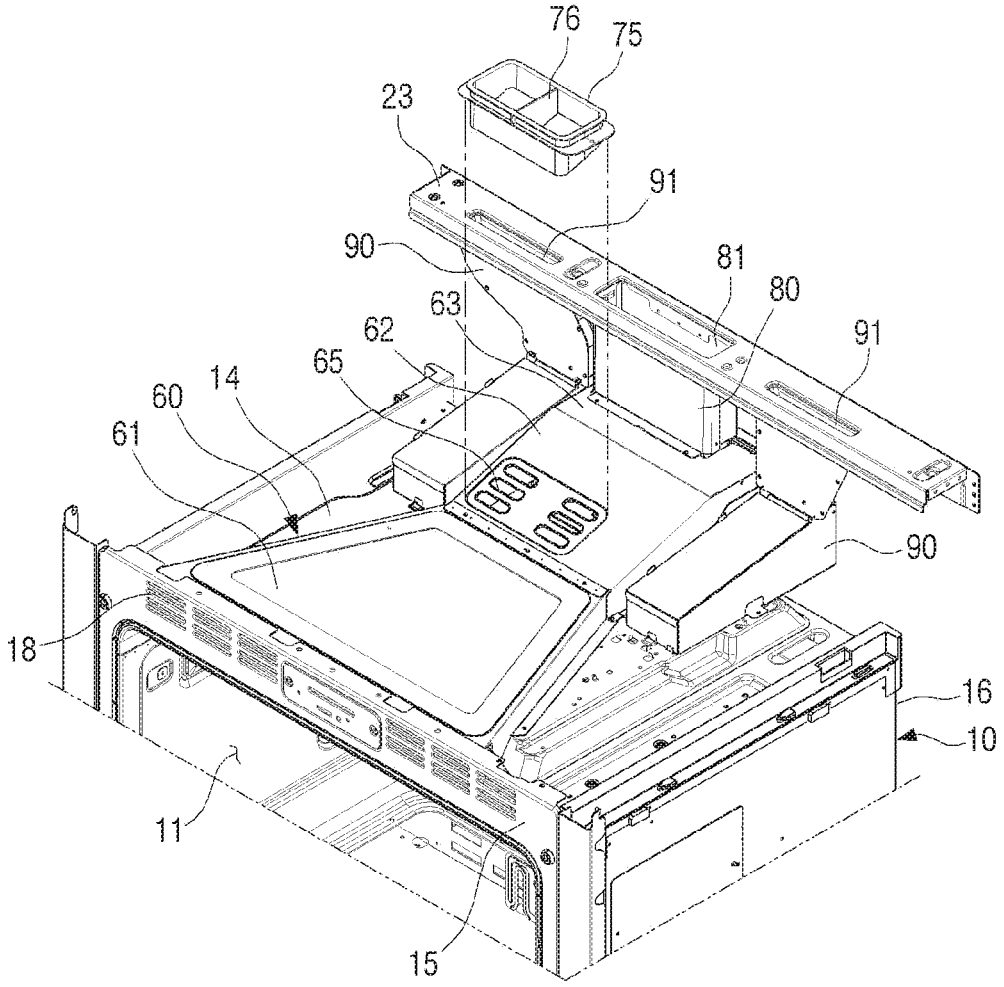
FIG. 8 is an exploded perspective view illustrating a state in which a connection duct is separated from the first cooling duct of FIG. 7.

FIG. 2 is a perspective view illustrating a cooking appliance having a cooling system according to an embodiment of the present disclosure. FIG. 3 is a cross-sectional view illustrating a cooking appliance having a cooling system according to an embodiment of the present disclosure. FIG. 4 is a perspective view illustrating an inside of a cooktop of the cooking appliance having a cooling system FIG. 2, and FIG. 5 is a rear perspective view illustrating an inside of a cooktop of the cooking appliance having a cooling system FIG. 2. FIG. 6 is a partial perspective view illustrating a second suction port of a second cooling duct of the cooking appliance having a cooling system of FIG. 2. FIG. 7 is a perspective view illustrating a first cooling duct and an exhaust duct of the cooking appliance having a cooling system of FIG. 2, and FIG. 8 is an exploded perspective view illustrating a state in which a connection duct is separated from the first cooling duct of FIG. 7.

Referring to FIGS. 2 and 3, a cooking appliance 1 having a cooling system according to an embodiment of the present disclosure may include an oven 10, a cooktop 20, an electrical component 30, and a cooling system 40.

The oven 10 is formed in a substantially rectangular parallelepiped shape, and a cooking chamber 11 in which food is accommodated is proved in the oven 10. A heating source (not illustrated) configured to heat food is provided in the cooking chamber 11. A gas burner, an electric heater, or the like may be used as the heating source. The internal structure of the oven 10 is the same or similar to a gas oven, an electric oven, and the like according to the prior art; therefore, a detailed description thereof is omitted.

A door 12 configured to open and close the cooking chamber 11 is provided in the front surface of the oven 10. The door 12 may be disposed to be rotated approximately 90 degrees by hinges provided at the lower portion thereof. A door air passage 13 through which outside air passes is provided inside the door 12. Openings 12*a* and 12*b* are provided at the upper and lower ends, respectively, of the door 12 to allow air to be introduced into the door air passage 13. Therefore, the lower end of the door air passage 13 is opened to the outside of the oven 10.

The cooktop 20 is provided at the upper side of the oven 10 and is formed in a hollow substantially rectangular parallelepiped shape. For example, the cooktop 20 may include a front surface 21, a rear surface 22, a cooktop top surface 23, a bottom surface 24, and both side surfaces 25 and 26. For reference, FIGS. 3 and 4 illustrate the cooktop 20, the cook top surface 23 of which is removed to show the inside of the cooktop 20.

The cook top surface 23 of the cooktop 20 is provided with a plurality of heating sources 50 capable of heating a container containing food. In the case of the embodiment illustrated in FIGS. 2 and 3, six gas burners are used as the heating sources 50. However, the heating source 50 of the cooktop 20 is not limited to the gas burner. In addition to the gas burner, an electromagnetic induction heater, an electric heater, or the like may be used as the heating source 50. In other words, an induction cooktop, a highlight cooktop, and a hybrid cooktop may be used as the cooktop 20.

The front surface 21 of the cooktop 20 is provided with a plurality of rotary switches 51 that can control the plurality of heating sources 50 of the cooktop 20 and the oven 10. In addition, an electrical component 30 for controlling the cooktop 20 and the oven 10 may be provided inside the front surface 21 of the cooktop 20. The electrical component 30 may be provided at substantially the center of the front surface 21 of the cooktop 20. For example, a display configured to display the state of the cooktop 20 and the oven 10 may be provided as the electrical component 30. Alternatively, the electrical component 30 may include a display and a printed circuit board on which a processor configured to control the cooktop and the oven is disposed. At this time, as illustrated in FIG. 6, the front surface of the display 30 is exposed to the outside through an opening 21*a* provided in the front surface 21 of the cooktop 20.

The cooling system 40 is provided to cool the outer surface of the oven 10 and the electrical component 30 of the cooktop 20 by using a single exhaust fan 41, and may include a first cooling duct 60, a second cooling duct 70, and an exhaust duct 80.

As illustrated in FIGS. 3 and 7, the first cooling duct 60 is provided on the oven top surface 14 of the oven 10 to cool the oven top surface 14 of the oven 10. In other words, the first cooling duct 60 is provided between the oven top surface 14 of the oven 10 and the bottom surface 24 of the cooktop 20. Therefore, the bottom surface 24 of the cooktop 20 is spaced apart from the oven top surface 14 of the oven 10 by a predetermined distance.

The first cooling duct 60 may be formed in a channel shape without a bottom so that the sucked air may directly contact the oven top surface 14 of the oven 10. One end of the first cooling duct 60 is connected to a first suction port 18 provided on the front surface 15 of the oven 10.

The first suction port 18 may be provided as a plurality of slits at the upper portion of the front surface 15 of the oven 10 as illustrated in FIG. 7. Therefore, the outside air may be introduced into the first cooling duct 60 through the first suction port 18. Because the door 12 is disposed on the front surface 15 of the oven 10, when the door 12 is closed, the first suction port 18 is not exposed to the outside. However, because there is a gap between the door 12 of the oven 10 and the bottom surface 24 of the cooktop 20, the outside air may be introduced into the first suction port 18 through the space between the door 12 and the bottom surface 24 of the cooktop 20.

The first cooling duct 60 may include a first duct section 61 connected to the first suction port 18 and a second duct section 62 connected to the first duct section 61. The first duct section 61 may be formed so that the width of the first duct section 61 is gradually narrower than the width of the first suction port 18 in the advancing direction of the sucked outside air. For example, the width of one end of the first duct section 61 connected to the first suction port 18 is wider than the width of the other end of the first duct section 61 connected to the second duct section 62. In addition, the first duct section 61 is formed in a shape in which the height of the first duct section 61 gradually increases in the advancing direction of the outside air. For example, the height of one end of the first duct section 61 connected to the first suction port 18 is lower than the height of the other end of the first duct section 61 connected to the second duct section 62. However, although not illustrated, the first duct section 61 may be formed to have the same height over the entire length.

One end of the second duct section 62 is connected to the first duct section 61, and the other end of the second duct section 62 is connected to a connecting section in which the exhaust fan 41 is disposed. The second duct section 62 is formed to have a height that gradually increases in the advancing direction of the outside air than the first duct section 61. In detail, the height of one end of the second duct section 62 is the same as the height of the first duct section 61, and the height of the other end of the second duct section 62 connected to the exhaust fan 41 is higher than the height of the first duct section 61. The width of the second duct section 62 is formed to be equal to the width of the other end of the first duct section 61.

The exhaust duct 80 is disposed on the rear surface 22 of the cooktop 20 and is connected to the rear end of the first cooling duct 60. The exhaust duct 80 is disposed in a direction perpendicular to the bottom surface 24 of the cooktop 20, that is, in a direction perpendicular to the first cooling duct 60. An exhaust port 81 communicating with the exhaust duct 80 is provided in the cook top surface 23 of the cooktop 20. Accordingly, the outside air passing through the first cooling duct 60 is discharged to the outside of the cooking appliance 1 through the exhaust duct 80.

The exhaust fan 41 is disposed in a connecting section 63 between the first cooling duct 60 and the exhaust duct 80. The exhaust fan 41 is disposed inside the connecting section 63 to which the rear end of the first cooling duct 60 and one end of the exhaust duct 80 are connected, and is configured to generate a suction force to suck outside air into the first cooling duct 60. The outside air sucked by the exhaust fan 41 passes through the exhaust fan 41 and is discharged to the outside through the exhaust duct 80. Various kinds of fans may be used as the exhaust fan 41 as long as they can generate the suction force for sucking the outside air.

Two oven exhaust ducts 90 to communicate with the cooking chamber 11 of the oven 10 may be provided at left and right sides of the first cooling duct 60 and the exhaust duct 80. In detail, one ends of the oven exhaust ducts 90 are in communication with an upper portion of the cooking chamber 11 of the oven 10, and the other ends of the oven exhaust ducts 90 are in communication with oven outlets 91 provided at a rear portion of the cook top surface 23 of the cooktop 20, that is, near the rear surface 22 of the cooktop 20. Therefore, the steam generated when cooking food with the oven 10 is discharged to the outside of the cooking appliance 1 through the two oven exhaust ducts 90.

The second cooling duct 70 is provided inside the cooktop 20 to cool the electrical component 30 disposed in the cooktop 20. For example, the second cooling duct 70 is formed so that the outside air is sucked through the front surface 21 of the cooktop 20, passes the electrical component 30 inside the cooktop 20, and then is discharged to the first cooling duct 60. The front surface 21 of the cooktop 20 is provided with a second suction port 28 through which outside air is sucked into the second cooling duct 70. The second suction port 28 may be provided in the front surface 21 of the cooktop 20 above the electrical component 30. The second cooling duct 70 is connected to the first cooling duct 60 at the rear of the electrical component 30. In other words, the outlet 71 of the second cooling duct 70 may be provided behind the electrical component 30 based on the moving direction of the air. For example, the outlet 71 of the second cooling duct 70 may be provided to be connected to the first cooling duct 60 at a position closer to the exhaust duct 80 than the electrical component 30. Thus, the electrical component 30 provided in the cooktop 20 may be cooled by using the outside air sucked by the exhaust fan 41 provided in the first cooling duct 60.

In the present embodiment, as illustrated in FIG. 3, the cooktop 20 itself forms the second cooling duct 70. In detail, the front surface 21, the rear surface 22, the top surface 23, the bottom surface 24, and both side surfaces 25 and 26 of the cooktop 20 form the second cooling duct 70. The front surface 21 of the cooktop 20 is provided with the second suction port 28 through which the outside air is sucked into the second cooling duct 70.

As illustrated in FIG. 6, the second suction port 28 may be provided in a lower surface of a protruding portion 27 protruding from the front surface 21 of the cooktop 20 over the plurality of rotary switches 51. The second suction port 28 may include a plurality of slits and a plurality of rectangular holes formed in the lower surface of the protruding portion 27. Because the inside of the protruding portion 27 of the cooktop 20 is empty, the outside air may be introduced into the inside of the cooktop 20, that is, the second cooling duct 70, through the second suction port 28.

The bottom surface 24 of the cooktop 20 is provided with the outlet 71 through which the outside air sucked into the second suction port 28 is discharged. In other words, the outlet 71 of the second cooling duct 70 is formed in the bottom surface 24 of the cooktop 20. In the present embodiment, the outlet 71 of the second cooling duct 70 is formed in two square or rectangular holes. In the embodiment illustrated in FIG. 4, the outlet 71 of the second cooling duct 70 is formed in two rectangular holes; however, the shape of the outlet 71 is not limited thereto. Although not illustrated, the outlet 71 of the second cooling duct 70 may be formed in various shapes such as a rectangular hole, a circular hole, an elliptical hole, and the like.

In the present embodiment, because the bottom surface 24 of the cooktop 20 is spaced apart from the top surface of the first cooling duct 60, a connection duct 75 is provided between the outlet 71 of the second cooling duct 70 and the top surface of the first cooling duct 60.

The connection duct 75 is formed to connect the first cooling duct 60 and the second cooling duct 70. In other words, the connection duct 75 is provided perpendicular to the bottom surface 24 of the cooktop 20 between the first cooling duct 60 and the second cooling duct 70 to connect the first cooling duct 60 and the second cooling duct 70. In detail, the connection duct 75 is formed to connect the outlet 71 of the second cooling duct 70 and a communication port 65 of the first cooling duct 60. For example, as illustrated in FIGS. 7 and 8, the connection duct 75 may be formed in a rectangular pipe having a size corresponding to two rectangular holes forming the outlet 71 of the second cooling duct 70. A partition 76 may be provided at the center of the rectangular pipe 75 to divide the inside of the pipe 75 into two spaces in the longitudinal direction.

The communication port 65 to communicate with the connection duct 75 is provided in the top surface of the first cooling duct 60. Accordingly, one end of the connection duct 75 is connected to the outlet 71 of the bottom surface 24 of the cooktop 20, and the other end of the connection duct 75 is connected to the communication port 65 of the first cooling duct 60. The communication port 65 of the first cooling duct 60 may be formed in a plurality of holes 64 in an area corresponding to the cross-sectional area of the connection duct 75. In the present embodiment, as illustrated in FIG. 8, the communication port 65 of the first cooling duct 60 is formed in six elongated holes 64.

Accordingly, the outside air introduced into the second suction port 28 provided on the front surface 21 of the cooktop 20 passes the electrical component 30 disposed inside the cooktop 20, and then enters the communication port 65 of the first cooling duct 60 through the outlet 71 on the bottom surface 24 of the cooktop 20 and the connection duct 75.

Hereinafter, the cooling operation of the cooking appliance 1 having a cooling system according to an embodiment of the present disclosure will be described in detail with reference to FIG. 9.

Figure 9:
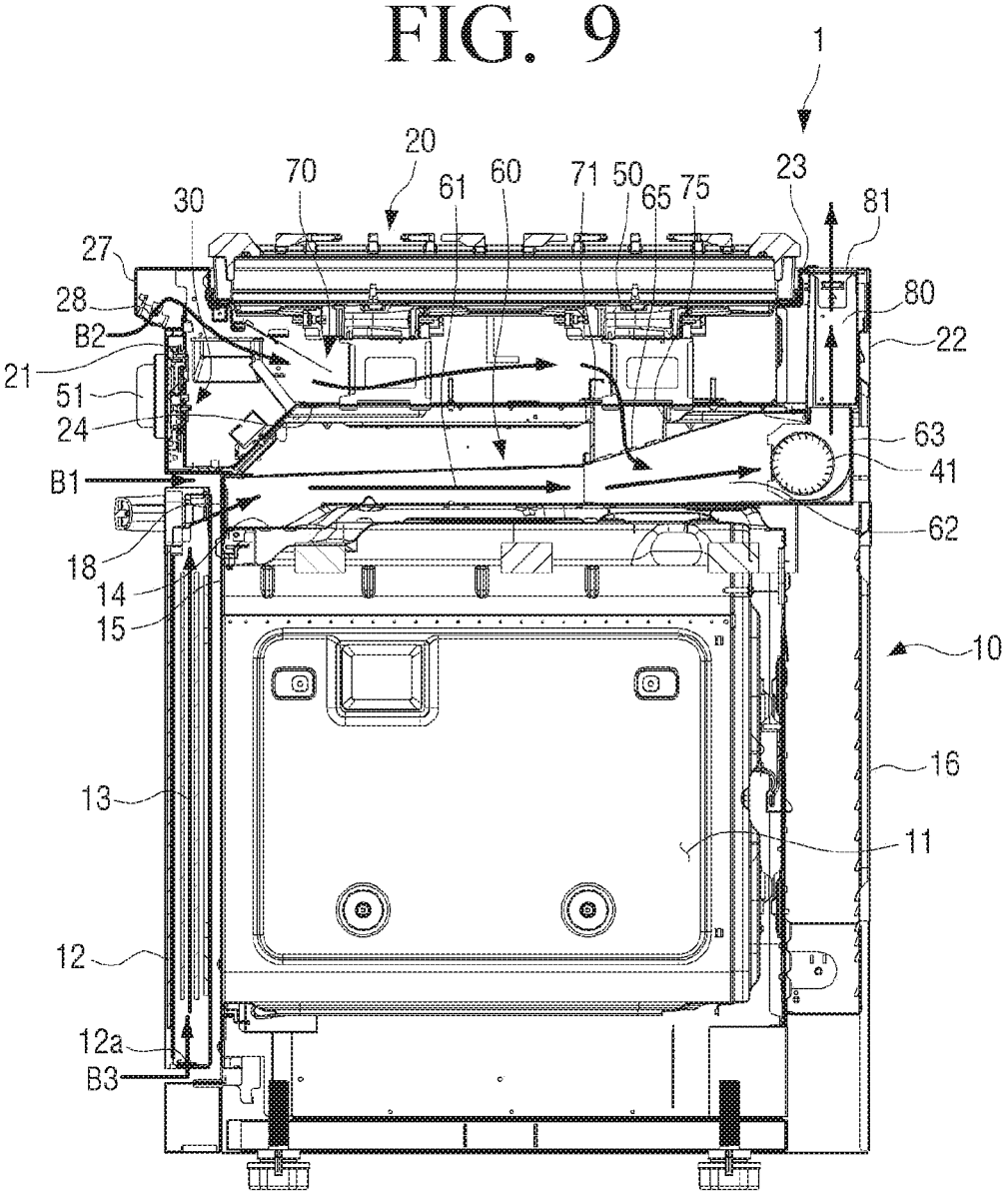
FIG. 9 is a cross-sectional view illustrating an air flow when an exhaust fan is operated in a cooking appliance having a cooling system according to an embodiment of the present disclosure.

FIG. 9 is a cross-sectional view illustrating an air flow when an exhaust fan is operated in a cooking appliance having a cooling system according to an embodiment of the present disclosure.

When food is cooked by at least one of the cooktop 20 and the oven 10, the exhaust fan 41 disposed in the connecting section 63 between the first cooling duct 60 and the exhaust duct 80 is operated.

When the exhaust fan 41 is operated, outside cold air is introduced into the cooling system 40 through the first suction port 18 provided in the front surface 15 of the oven 10, the second suction port 28 provided in the front surface 21 of the cooktop 20, and the opening 12*a* provided at the lower end of the door 12.

The outside air (arrow B1) introduced into the first suction port 18 provided in the front surface 15 of the oven 10 passes through the first cooling duct 60, passes through the exhaust fan 41 disposed in the connecting section 63, and then is discharged to the outside of the cooking appliance 1 through the exhaust duct 80. At this time, because the first cooling duct 60 is disposed on the oven top surface 14 of the oven 10, when the outside cold air passes through the first cooling duct 60, the oven top surface 14 of the oven 10 is cooled.

The outside air (arrow B2) introduced into the second suction port 28 provided in the front surface 21 of the cooktop 20 passes through the second cooling duct 70, that is, the inside of the cooktop 20, and then is discharged through the outlet 71 provided on the bottom surface 24 of the cooktop 20. The outside air discharged through the outlet 71 is introduced into the communication port 65 of the first cooling duct 60 through the connection duct 75 connecting the first cooling duct 60 and the second cooling duct 70.

The outside air introduced into the communication port 65 of the first cooling duct 60 is discharged to the outside of the cooktop 20 through the first cooling duct 60 and the exhaust duct 80. In detail, the outside air introduced into the first cooling duct 60 through the connection duct 75 is mixed with the outside air introduced into the first suction port 18, and the mixed air passes through the exhaust fan 41, and then is discharged to the outside of the cooking appliance 1 through the exhaust duct 80. At this time, when the outside cold air sucked into the second suction port 28 passes the electrical component 30 disposed inside the cooktop 20, the electrical component 30 is cooled. Therefore, the electrical component 30 may be prevented from being heated above a predetermined temperature by the radiant heat of the burner 50 generated when cooking with the cooktop 20 or the conductive heat of the oven 10 generated when cooking with the oven 10.

The outside air (arrow B3) sucked into the opening 12*a* provided at the lower end of the door 12 passes through the door air passage 13 of the door 12 and moves to the upper end of the door 12. The outside air moved to the upper end of the door 12 is introduced into the first cooling duct 60 through the first suction port 18 provided at the front surface 15 of the oven 10. The outside air introduced into the first cooling duct 60 is discharged to the outside of the cooking appliance 1 through the exhaust fan 41 and the exhaust duct 80.

Because the rear surface 16 of the oven 10 is directly exposed to the outside, the rear surface 16 of the oven 10 may be cooled by being in direct contact with the outside air. In other words, the rear surface 16 of the oven 10 may be cooled by natural convection of air.

As described above, the cooking appliance 1 having a cooling system according to an embodiment of the present disclosure includes the second cooling duct 70 capable of cooling the electrical component 30 inside the cooktop 20. Therefore, when cooking food with the cooking appliance 1, the electrical component 30 disposed inside the cooktop 20 may be prevented from rising above a predetermined temperature.

The present inventors confirmed that in a cooking appliance in which the second cooling duct is not provided inside the cooktop, when cooking food, the temperature of the electrical component inside the cooktop rises to 90° C. or more so that the cooking appliance does not satisfy the specified temperature of 80° C. However, in the cooking appliance 1 having a cooling system according to an embodiment of the present disclosure, when cooking food, the electrical component 30 disposed inside the cooktop 20 rises to about 55° C., so that the cooking appliance 1 satisfies the specified temperature.

Hereinafter, a cooking appliance having a cooling system according to an embodiment of the present disclosure will be described in detail with reference to FIGS. 10 to 13.

Figure 10:
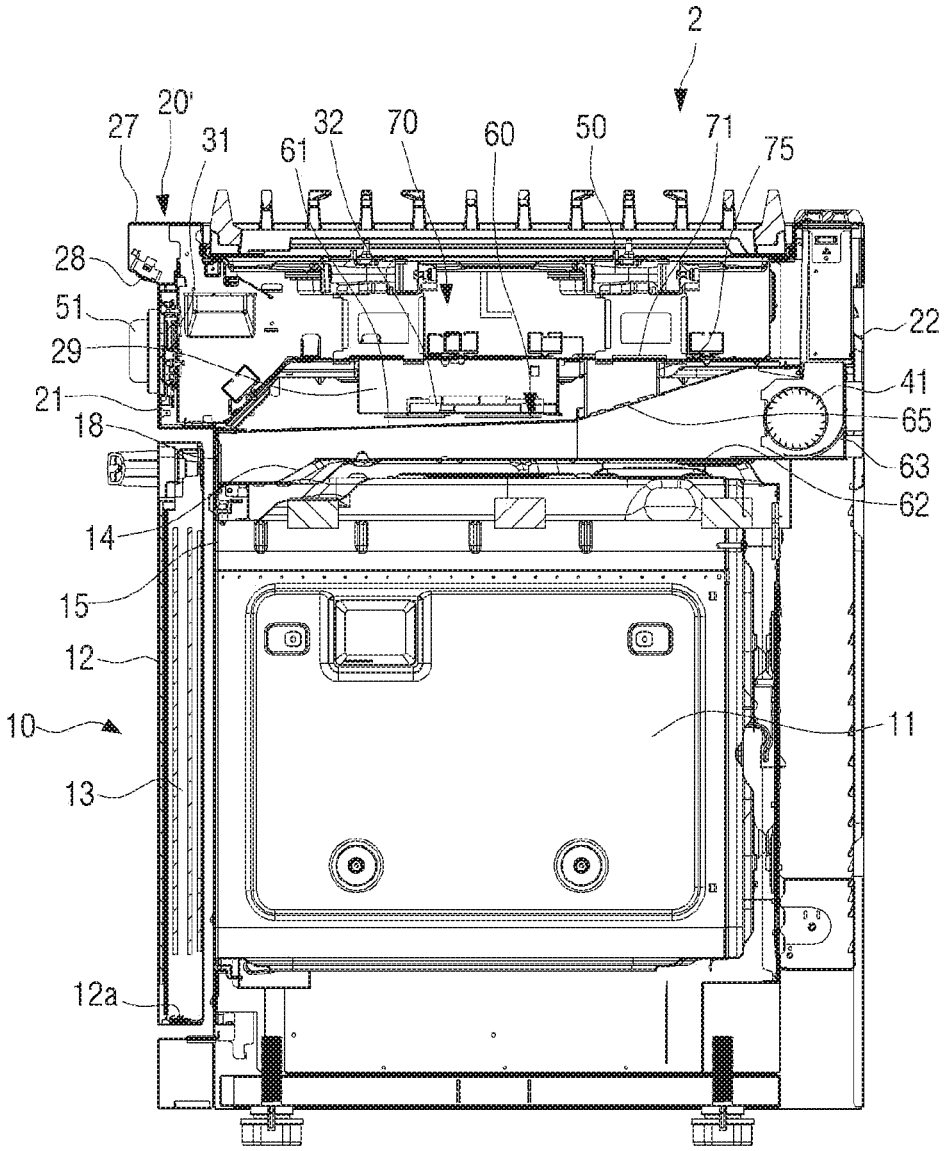
FIG. 10 is a cross-sectional view illustrating a cooking appliance having a cooling system according to an embodiment of the present disclosure.
Figure 11:
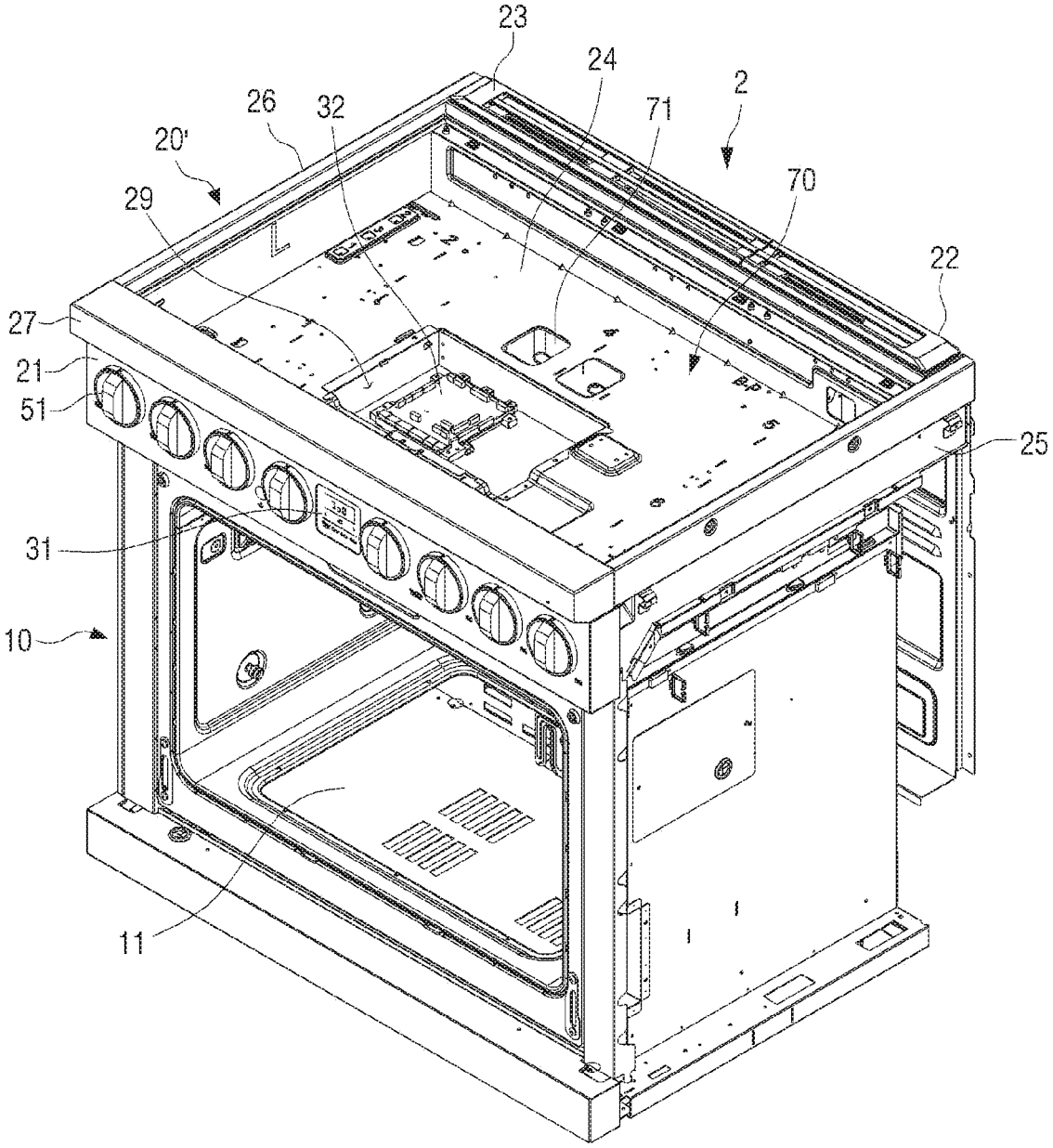
FIG. 11 is a perspective view illustrating an inside of a cooktop of the cooking appliance having a cooling system FIG. 10.
Figure 12:
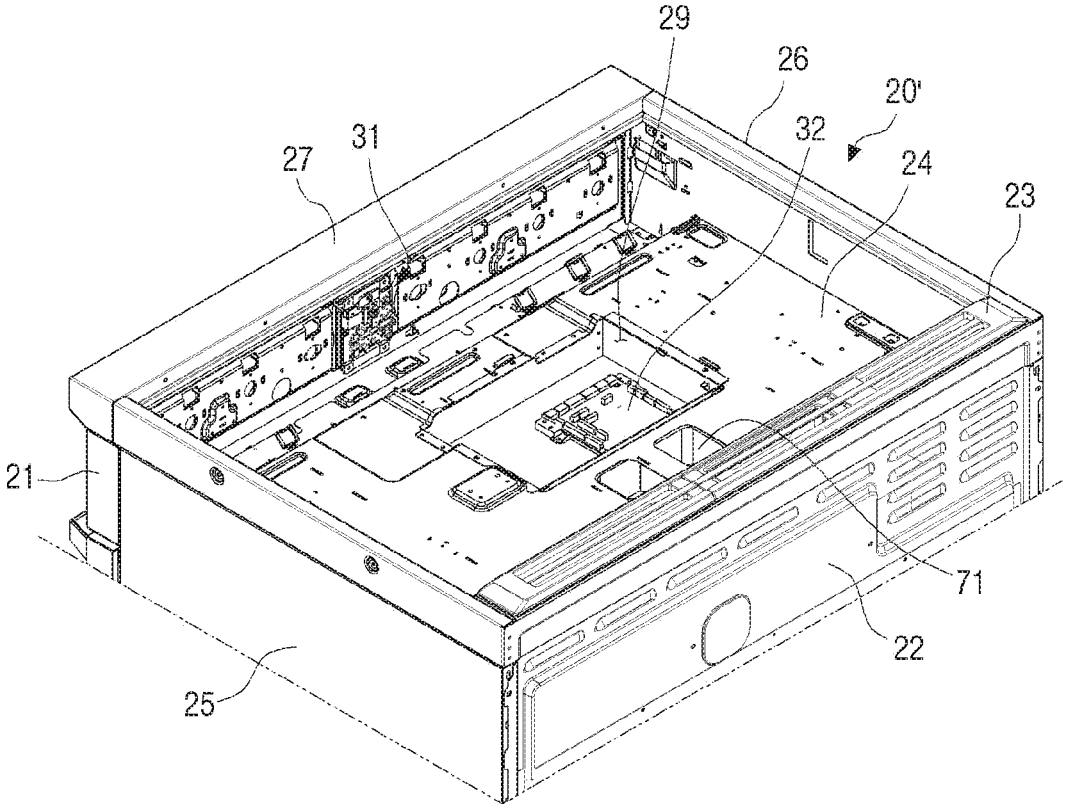
FIG. 12 is a rear perspective view illustrating an inside of a cooktop of the cooking appliance having a cooling system FIG. 10.
Figure 13:
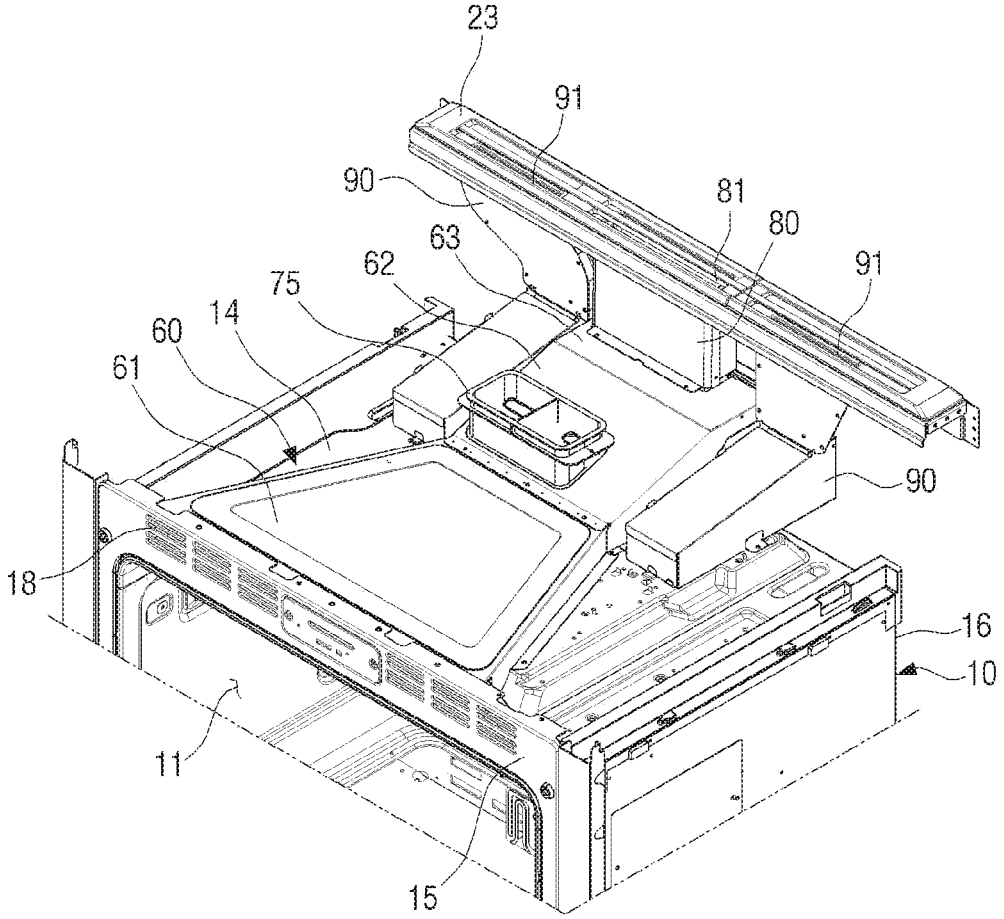
FIG. 13 is a perspective view illustrating a first cooling duct and an exhaust duct of the cooking appliance having a cooling system of FIG. 10.

FIG. 10 is a cross-sectional view illustrating a cooking appliance having a cooling system according to an embodiment of the present disclosure. FIG. 11 is a perspective view illustrating an inside of a cooktop of the cooking appliance having a cooling system FIG. 10. FIG. 12 is a rear perspective view illustrating an inside of a cooktop of the cooking appliance having a cooling system of FIG. 10. FIG. 13 is a perspective view illustrating a first cooling duct and an exhaust duct of the cooking appliance having a cooling system of FIG. 10.

Referring to FIGS. 10 and 11, a cooking appliance 2 having a cooling system according to an embodiment of the present disclosure may include an oven 10, a cooktop 20', a first electrical component 31, a second electrical component 32, and a cooling system 40.

The oven 10 is formed in a substantially rectangular parallelepiped shape, and a cooking chamber 11 in which food is accommodated is provided inside the oven 10. A heating source (not illustrated) configured to heat food is provided in the cooking chamber 11. A gas burner, an electric heater, or the like may be used as the heating source. The internal structure of the oven 10 is the same as or similar to a gas oven, an electric oven, and the like according to the prior art; therefore, a detailed description thereof is omitted.

A door 12 configured to open and close the cooking chamber 11 is provided in the front surface 15 of the oven 10. The door 12 may be disposed to be rotated approximately 90 degrees by hinges provided at the lower portion thereof. A door air passage 13 through which outside air passes is provided inside the door 12. Openings 12*a* are provided at the upper and lower ends of the door 12 to allow air to be introduced into the door air passage 13. Therefore, the lower end of the door air passage 13 is opened to the outside.

The cooktop 20' is provided at the upper side of the oven 10 and is formed in a hollow substantially rectangular parallelepiped shape. For example, the cooktop 20' may include a front surface 21, a rear surface 22, a top surface 23, a bottom surface 24, and both side surfaces 25 and 26. For reference, FIGS. 11 and 12 illustrate the cooktop 20', the cook top surface 23 of which is removed to show the inside of the cooktop 20'.

The cook top surface 23 of the cooktop 20' is provided with a plurality of heating sources 50 capable of heating a container containing food. In the case of the present embodiment, a plurality of gas burners are used as the heating source 50. However, the heating source 50 of the cooktop 20' is not limited to the gas burner. In addition to the gas burner, an electromagnetic induction heater, an electric heater, or the like may be used as the heating source 50. In other words, an induction cooktop, a highlight cooktop, and a hybrid cooktop may be used as the cooktop 20'.

The front surface 21 of the cooktop 20' is provided with a plurality of rotary switches 51 that can control the plurality of heating sources 50 of the cooktop 20' and the oven 10.

The first electrical component 31 and the second electrical component 32 may be disposed inside the cooktop 20'. The first electrical component 31 may be provided in the inner surface of the front surface 21 of the cooktop 20', and the second electrical component 32 may be provided on the bottom surface 24 of the cooktop 20'. In detail, the first electrical component 31 may be centrally provided in the longitudinal direction on the inner surface of the front surface 21 of the cooktop 20'. For example, the first electrical component 31 may be implemented as a display configured to display the state of the cooktop 20' and the oven 10. At this time, the front surface of the display 31 may be exposed to the outside through an opening 21*a* provided in the front surface 21 of the cooktop 20' (see FIG. 6).

The second electrical component 32 may be disposed in a receiving portion 29 formed in the bottom surface 24 of the cooktop 20'. The receiving portion 29 may be formed as a rectangular groove formed lower than the bottom surface 24 of the cooktop 20'. The second electrical component 32 is provided on the bottom surface of the receiving portion 29. In the case of the present embodiment as illustrated in FIGS. 11 and 12, the second electrical component 32 is provided in the recessed receiving portion 29; however, the installation position of the second electrical component 32 is not limited thereto. Although not illustrated, the second electrical component 32 may be disposed on the bottom surface 24 of the cooktop 20' without the recessed receiving portion 29. The second electrical component 32 may include various electrical components related to the cooking appliance 2. For example, the second electrical component 32 may be implemented as a printed circuit board on which a processor for controlling the cooktop 20' and the oven 10 is provided.

The cooling system 40 is provided to cool the outer surface of the oven 10 and the first electrical component 31 and the second electrical component 32 provided inside the cooktop 20' by using a single exhaust fan 41, and may include a first cooling duct 60, a second cooling duct 70, and an exhaust duct 80.

As illustrated in FIGS. 10 and 13, the first cooling duct 60 is provided on the oven top surface 14 of the oven 10 to cool the oven top surface 14 of the oven 10. In other words, the first cooling duct 60 is provided between the oven top surface 14 of the oven 10 and the bottom surface 24 of the cooktop 20'. Therefore, the bottom surface 24 of the cooktop 20' is spaced apart from the oven top surface 14 of the oven 10 by a predetermined distance. In addition, the receiving portion 29 provided on the bottom surface 24 of the cooktop 20' is formed so as not to interfere with the first cooling duct 60.

The first cooling duct 60 may be formed in a channel shape without a bottom so that the sucked air may directly contact the oven top surface 14 of the oven 10. One end of the first cooling duct 60 is connected to a first suction port 18 provided on the front surface 15 of the oven 10.

The first suction port 18 may be provided as a plurality of slits at the upper portion of the front surface 15 of the oven 10 as illustrated in FIG. 13. Therefore, the outside air may be introduced into the first cooling duct 60 through the first suction port 18. Because the door 12 is disposed on the front surface 15 of the oven 10, when the door 12 is closed, the first suction port 18 is not exposed to the outside. However, because there is a gap between the upper end of the door 12 and the bottom surface 24 of the cooktop 20', the outside air may be introduced into the first suction port 18 through the space between the upper end of the door 12 and the bottom surface 24 of the cooktop 20'.

The first cooling duct 60 may include a first duct section 61 connected to the first suction port 18 and a second duct section 62 connected to the first duct section 61. The first duct section 61 may be formed such that the width of the first cooling duct 60 is gradually smaller than the width of the first suction port 18 in the advancing direction of the sucked outside air. For example, as illustrated in FIG. 13, the width of one end of the first duct section 61 connected to the first suction port 18 is wider than the width of the other end of the first duct section 61 connected to the second duct section 62. In addition, the first duct section 61 may be formed in a shape in which the height of the first duct section 61 gradually increases in the advancing direction of the outside air. For example, as illustrated in FIG. 10, the height of one end of the first duct section 61 connected to the first suction port 18 is lower than the height of the other end of the first duct section 61 connected to the second duct section 62. However, although not illustrated, the first duct section 61 may be formed to have the same height over the entire length.

One end of the second duct section 62 is connected to the first duct section 61, and the other end of the second duct section 62 is connected to a connecting section 63 in which the exhaust fan 41 is disposed. The second duct section 62 is formed in a shape in which the height thereof increases gradually in the advancing direction of the outside air than the height of the first duct section 61. In detail, as illustrated in FIG. 10, the height of one end of the second duct section 62 is the same as the height of the first duct section 61, and the height of the other end of the second duct section 62 connected to the exhaust fan 41 is higher than the height of the first duct section 61. The width of the second duct section 62 is formed to be equal to the width of the other end of the first duct section 61.

The exhaust duct 80 is disposed on the rear surface 22 of the cooktop 20' and is connected to the rear end of the first cooling duct 60. The exhaust duct 80 is disposed in a direction perpendicular to the bottom surface 24 of the cooktop 20', that is, in a direction perpendicular to the first cooling duct 60. An exhaust port 81 communicating with the exhaust duct 80 is provided in the cook top surface 23 of the cooktop 20'. Accordingly, the outside air passing through the first cooling duct 60 is discharged to the outside of the cooking appliance 2 through the exhaust duct 80.

The exhaust fan 41 is disposed in the connecting section 63 between the first cooling duct 60 and the exhaust duct 80. The exhaust fan 41 is disposed inside the connecting section 63 to which the rear end of the first cooling duct 60 and one end of the exhaust duct 80 are connected. The exhaust fan 41 is configured to generate a suction force to suck outside air into the first cooling duct 60. The outside air sucked by the exhaust fan 41 passes through the exhaust fan 41 and is discharged to the outside through the exhaust duct 80. Various kinds of fans may be used as the exhaust fan 41 as long as they can generate a suction force for sucking outside air.

As illustrated in FIGS. 13, two oven exhaust ducts 90 to communicate with the cooking chamber 11 of the oven 10 may be provided at left and right sides of the first cooling duct 60 and the exhaust duct 80. In detail, one ends of the oven exhaust ducts 90 are in communication with an upper portion of the cooking chamber 11 of the oven 10, and the other ends of the oven exhaust ducts 90 are in communication with oven outlets 91 provided at a rear portion of the top surface of the cooktop 20, that is, near the rear surface 22 of the cooktop 20. Therefore, the steam generated when cooking food with the oven 10 is discharged to the outside of the cooking appliance 2 through the two oven exhaust ducts 90.

The second cooling duct 70 is provided inside the cooktop 20' to cool the first electrical component 31 and the second electrical component 32 disposed in the cooktop 20'. For example, the second cooling duct 70 is formed so that the outside air is sucked through the front surface 21 of the cooktop 20', passes the first electrical component 31 and the second electrical component 32 inside the cooktop 20', and then is discharged into the first cooling duct 60.

The front surface 21 of the cooktop 20' is provided with a second suction port 28 through which outside air is sucked into the second cooling duct 70. The second suction port 28 may be provided in the front surface 21 of the cooktop 20' above the first electrical component 31.

The second cooling duct 70 is connected to the first cooling duct 60 at the rear of the second electrical component 32 based on the moving direction of the air. In other words, the outlet 71 of the second cooling duct 70 may be provided behind the second electrical component 32. For example, the outlet 71 of the second cooling duct 70 may be provided to be connected to the first cooling duct 60 at a position closer to the exhaust duct 80 than the first electrical component 31, that is, at the rear of the second electrical component 32. In the case of the present embodiment as illustrated in FIG. 11, the outlet 71 of the second cooling duct 70 is provided behind the receiving portion 29 in which the second electrical component 32 is accommodated. In other words, the outlet 71 of the second cooling duct 70 may be provided in the bottom surface 24 of the cooktop 20' between the receiving portion 29 and the rear surface 22 of the cooktop 20'. Thus, the outside air introduced into the second cooling duct 70 through the second suction port 28 cools the first electrical component 31 and the second electrical component 32 provided inside the cooktop 20', and then is discharged into the first cooling duct 60 through the outlet 71.

In the present embodiment, as illustrated in FIG. 11, the cooktop 20' itself forms the second cooling duct 70. In detail, the front surface 21, the rear surface 22, the top surface 23, the bottom surface 24, and both side surfaces 25 and 26 of the cooktop 20' form the second cooling duct 70. The front surface 21 of the cooktop 20' is provided with the second suction port 28 through which the outside air is sucked into the cooktop 20', which is the second cooling duct 70.

The second suction port 28 may be provided in a lower surface of a protruding portion 27 protruding from the front surface 21 of the cooktop 20' over the plurality of rotary switches 51 (see FIG. 6). The second suction port 28 may include a plurality of slits and a plurality of rectangular holes formed on the lower surface of the protruding portion 27. Because the inside of the protruding portion 27 of the cooktop 20' is empty, the outside air may be introduced into the inside of the cooktop 20', that is, the second cooling duct 70, through the second suction port 28.

The bottom surface 24 of the cooktop 20' is provided with the outlet 71 through which the outside air sucked into the second suction port 28 is discharged. In other words, the outlet 71 of the second cooling duct 70 is formed on the bottom surface 24 of the cooktop 20'. In the present embodiment, the outlet 71 of the second cooling duct 70 is formed in two square or rectangular holes between the receiving portion 29 and the rear surface 22 of the cooktop 20'. In the present embodiment, the outlet 71 of the second cooling duct 70 is formed in two rectangular holes; however, the shape of the outlet 71 is not limited thereto. Although not illustrated, the outlet 71 of the second cooling duct 70 may be formed in various shapes such as a rectangular hole, a circular hole, an elliptical hole, and the like.

In the present embodiment, because the bottom surface 24 of the cooktop 20' provided with the receiving portion 29 in which the second electrical component 32 is disposed is spaced apart from the top surface of the first cooling duct 60, a connection duct 75 is provided between the outlet 71 of the second cooling duct 70 and the top surface of the first cooling duct 60.

The connection duct 75 is formed to connect the first cooling duct 60 and the second cooling duct 70. In other words, the connection duct 75 is provided perpendicular to the bottom surface 24 of the cooktop 20' between the first cooling duct 60 and the second cooling duct 70 to connect the first cooling duct 60 and the second cooling duct 70. In detail, the connection duct 75 is formed to connect the outlet 71 of the second cooling duct 70 and a communication port 65 of the first cooling duct 60. For example, as illustrated in FIG. 13, the connection duct 75 may be formed in a rectangular pipe having a cross-section corresponding to two rectangular holes provided in the bottom surface 24 of the cooktop 20' forming the outlet 71 of the second cooling duct 70. A partition 76 may be provided at the center of the rectangular pipe 75 to divide the inside of the pipe 75 into two spaces in the longitudinal direction.

The communication port 65 to be in communicate with the connection duct 75 is provided in the top surface of the first cooling duct 60. Accordingly, one end of the connection duct 75 is connected to the outlet 71 of the bottom surface 24 of the cooktop 20', and the other end of the connection duct 75 is connected to the communication port 65 of the first cooling duct 60. The communication port 65 of the first cooling duct 60 may be formed in a plurality of holes in an area corresponding to the cross-sectional area of the connection duct 75. In the present embodiment, the communication port 65 of the first cooling duct 60 may be formed in six elongated holes (see FIG. 8).

Accordingly, the outside air introduced into the second suction port 28 provided on the front surface 21 of the cooktop 20' passes the first electrical component 31 and the second electrical component 32 disposed inside the cooktop 20', and then is introduced into the communication port 65 of the first cooling duct 60 through the outlet 71 in the bottom surface 24 of the cooktop 20' and the connection duct 75.

Hereinafter, the cooling operation of the cooking appliance 2 having a cooling system according to an embodiment of the present disclosure will be described in detail with reference to FIG. 14.

Figure 14:
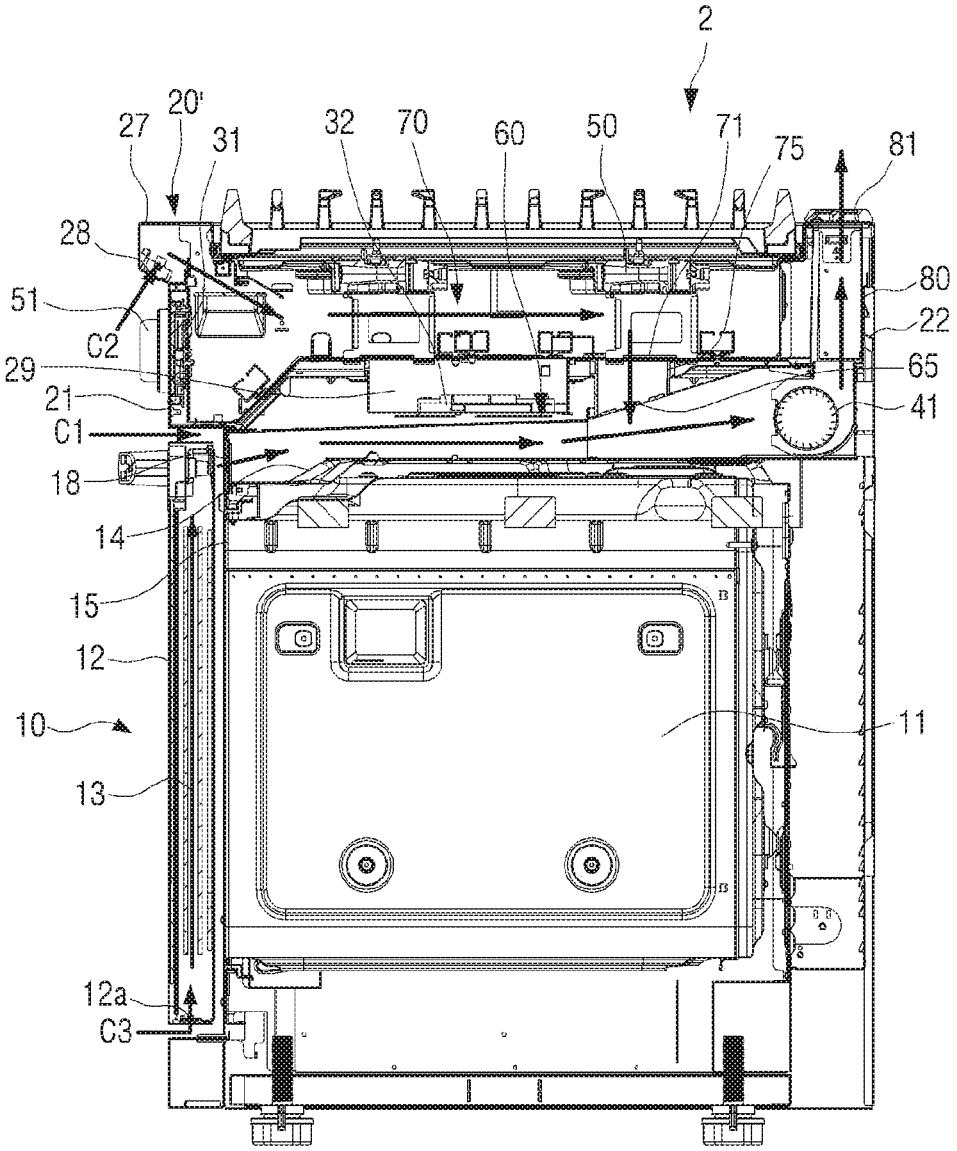
FIG. 14 is a cross-sectional view illustrating an air flow when an exhaust fan is operated in the cooking appliance having a cooling system of FIG. 10.

FIG. 14 is a cross-sectional view illustrating an air flow when an exhaust fan is operated in a cooking appliance having a cooling system according to an embodiment of the present disclosure.

When food is cooked by at least one of the cooktop 20' and the oven 10, the exhaust fan 41 disposed in the connecting section 63 between the first cooling duct 60 and the exhaust duct 80 is operated.

When the exhaust fan 41 is operated, outside cold air is introduced into the cooling system 40 through the first suction port 18 provided in the front surface 15 of the oven 10, the second suction port 28 provided in the front surface 21 of the cooktop 20', and the opening 12*a* provided at the lower end of the door 12.

The outside air (arrow C1) introduced into the first suction port 18 provided in the front surface 15 of the oven 10 passes through the first cooling duct 60, passes through the exhaust fan 41 disposed in the connecting section 63, and then is discharged to the outside of the cooking appliance 2 through the exhaust duct 80. At this time, because the first cooling duct 60 is disposed on the oven top surface 14 of the oven 10, when the outside cold air passes through the first cooling duct 60, the oven top surface 14 of the oven 10 is cooled by the outside air.

The outside air (arrow C2) introduced into the second suction port 28 provided in the front surface 21 of the cooktop 20' passes through the second cooling duct 70, that is, the inside of the cooktop 20', and then is discharged through the outlet 71 provided in the bottom surface 24 of the cooktop 20'. The outside air discharged through the outlet 71 is introduced into the communication port 65 of the first cooling duct 60 through the connection duct 75 connecting the first cooling duct 60 and the second cooling duct 70. The outside air introduced into the communication port 65 of the first cooling duct 60 is discharged to the outside of the cooktop 20' through the exhaust fan 41 and the exhaust duct 80. In detail, the outside air introduced into the first cooling duct 60 through the connection duct 75 is mixed with the outside air introduced into the first suction port 18, and the mixed outside air passes through the exhaust fan 41, and then is discharged to the outside of the cooking appliance 2 through the exhaust duct 80.

At this time, when the outside cold air sucked into the second suction port 28 passes the first electrical component 31 and the second electrical component 32 disposed inside the cooktop 20', the first electrical component 31 and the second electrical component 32 are cooled. Therefore, the first electrical component 31 and the second electrical component 32 may be prevented from being heated above a predetermined temperature by the radiant heat of the burner generated when cooking with the cooktop 20' or the conductive heat of the oven 10 generated when cooking with the oven 10.

The outside air (arrow C3) sucked into the opening 12*a* provided at the lower end of the door 12 passes through the door air passage 13 of the door 12 and moves to the upper end of the door 12. The outside air moved to the upper end of the door 12 is introduced into the first cooling duct 60 through the first suction port 18 provided in the front surface 15 of the oven 10. The outside air introduced into the first cooling duct 60 is discharged to the outside of the cooking appliance 2 through the exhaust fan 41 and the exhaust duct 80.

Because the rear surface 16 of the oven 10 is directly exposed to the outside, the rear surface 16 of the oven 10 may be cooled by being in direct contact with the outside air. In other words, the rear surface 16 of the oven 10 may be cooled by natural convection of air.

As described above, the cooking appliance 2 having a cooling system according to an embodiment of the present disclosure is provided with the second cooling duct 70 capable of cooling the first electrical component 31 and the second electrical component 32 inside the cooktop 20'. Therefore, when cooking food with the cooking appliance 2, the first and second electrical components 31 and 32 disposed inside the cooktop 20' may be prevented from rising above a predetermined temperature.

In the above description, the cooktop 20 and 20' itself serves as the second cooling duct 70. However, the structure of the second cooling duct 70 is not limited thereto. As an embodiment, the second cooling duct 70 may be formed by providing a duct member 77 inside the cooktop 20'.

Figure 15:
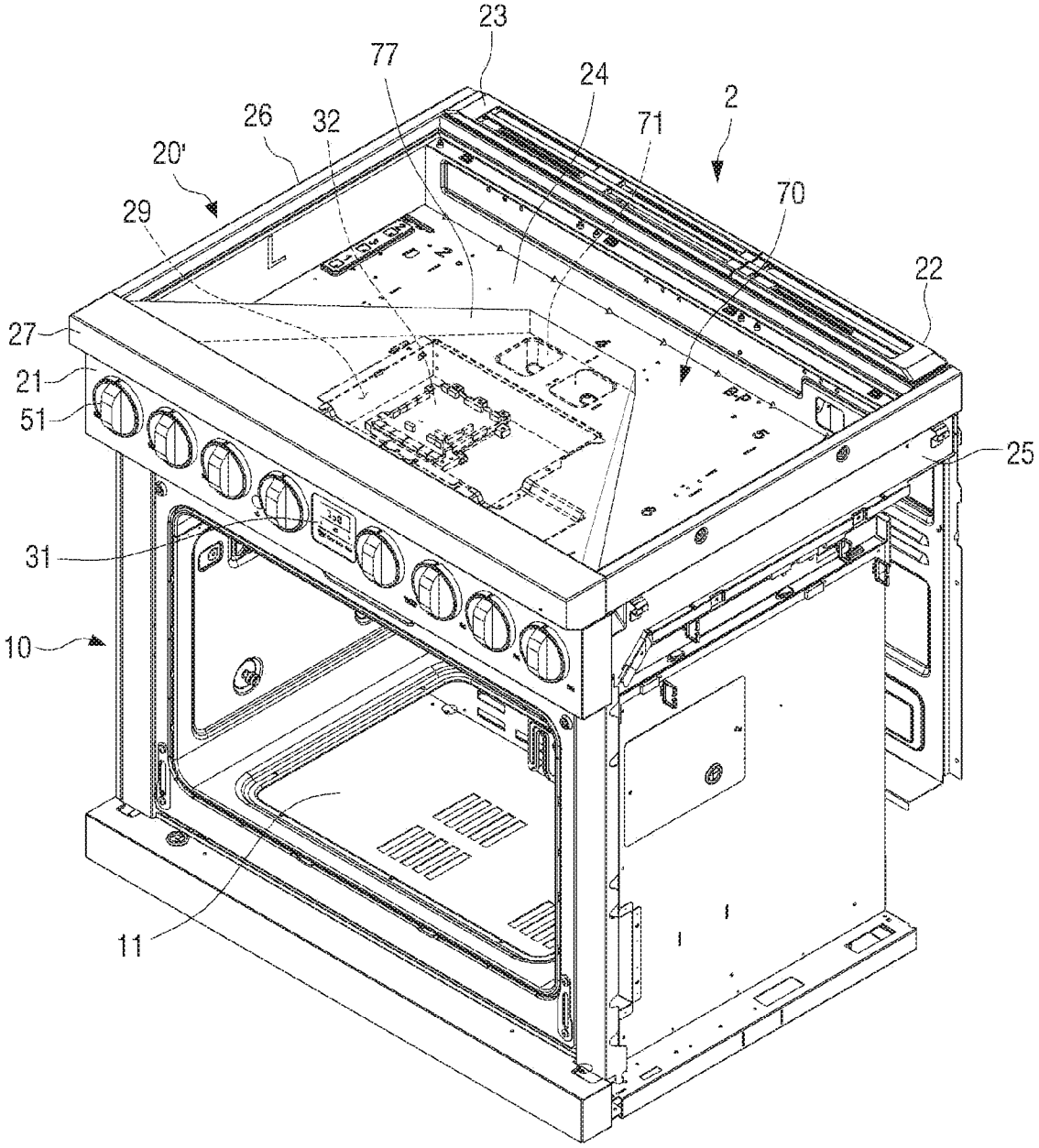
FIG. 15 is a perspective view illustrating a case in which a duct member is disposed inside a cooktop of a cooking appliance having a cooling system according to an embodiment of the present disclosure.

FIG. 15 is a perspective view illustrating a case in which a duct member is disposed inside a cooktop of a cooking appliance having a cooling system according to an embodiment of the present disclosure.

Referring to FIG. 15, a cooking appliance 3 having a cooling system according to an embodiment of the present disclosure may include an oven 10, a cooktop 20', and a cooling system 40.

The oven 10 of the cooking appliance 3 is the same as the oven 10 of the cooking appliance 2; therefore, a detailed description thereof is omitted.

The cooktop 20' and the cooling system 40 are similar to the cooktop 20' and the cooling system 40 of the cooking appliance 2 according to the above-described embodiment; therefore, the following description will focus on the differences.

A duct member 77 is provided on the bottom surface 24 of the cooktop 20' to form the second cooling duct 70. The duct member 77 is formed to cover the first electrical component 31 disposed on the front surface 21 of the cooktop 20' and the second electrical component 32 disposed on the bottom surface 24 of the cooktop 20'. The duct member 77 is formed so that one end of the duct member 77 communicates with the second suction port 28 formed in the front surface 21 of the cooktop 20' and the other end of the duct member 77 communicates with the outlet 71 formed in the bottom surface 24 of the cooktop 20'.

The duct member 77 may be formed such that the height of the duct member 77 gradually decreases in the advancing direction of the outside air. For example, the top surface of the duct member 77 may be disposed to be inclined downward in the advancing direction of the outside air. Therefore, the duct member 77 may be formed so that the height of one end of the duct member 77 connected to the second suction port 28 is higher than the height of the other end of the duct member 77 communicating with the outlet 71.

In addition, the duct member 77 may be formed so that the width of the duct member 77 gradually narrows in the moving direction of the outside air. For example, the width of one end of the duct member 77 connected to the second suction port 28 may be wider than the width of the other end of the duct member 77 communicating with the outlet 71.

The duct member 77 is formed in a channel shape without a bottom. Therefore, the outside air introduced into the second suction port 28 moves along the duct member 77, directly contacts the first electrical component 31 and the second electrical component 32, and then is discharged into the first cooling duct 60 through the outlet 71 formed in the bottom surface 24 of the cooktop 20'. In detail, the outside air discharged through the outlet 71 of the cooktop 20' is introduced into the communication port 65 of the first cooling duct 60 through the connection duct 75. Thereafter, the outside air introduced into the communication port 65 is mixed with the outside air introduced into the first cooling duct 60 through the first suction port 18, and then the mixed outside air is discharged to the outside of the cooking appliance 3 through the exhaust fan 41 and the exhaust duct 80.

In the cooking appliances 1, 2, and 3 having a cooling system as described above, the outside of the oven 10 may be cooled by outside air flowing through the first cooling duct 60, and the electrical components 30, 31, and 32 disposed inside the cooktop 20 and 20' may be cooled by the outside air flowing through the second cooling duct 70.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the inventive concepts.

What is claimed is:

1. A cooking appliance having a cooling system, the cooking appliance comprising:

an oven having a cooking chamber;

a cooktop to be positioned above the oven and including a front surface, a rear surface, a top surface, a bottom surface, a first side surface, and a second side surface;

a first electrical component disposed in at least one of the front surface of the cooktop and an interior of the cooktop;

a first suction port disposed in an upper portion of a front surface of the oven, the first suction port being positioned below the first electrical component;

a second suction port disposed in an upper portion of the front surface of the cooktop, the second suction port being positioned above the first electrical component;

a first cooling duct formed between an upper portion of the oven and the bottom surface of the cooktop and including:

a front portion configured to connect with the first suction port and a communication port formed at a top surface of the first cooling duct;

an exhaust port disposed in a rear of the cooktop and configured to connect with a rear portion of the first cooling duct;

a second cooling duct formed above the first cooling duct, the second cooling duct formed by the cooktop itself, and including an outlet formed on the bottom surface of the cooktop;

a space provided between the bottom surface of the cooktop and the top surface of the first cooling duct;

an exhaust fan disposed at a rear portion of the oven; and a connection duct provided in the space between the bottom surface of the cooktop and the top surface of the first cooling duct so that a bottom end of the connection duct is connected to the communication port of the first cooling duct and a top end of the connection duct is connected to the outlet of the second cooling duct;

wherein the exhaust fan is configured to draw air from the first suction port toward the first cooling duct, and draw air from the second suction port toward the second cooling duct so as to cool the first electrical component, wherein the air discharged from the outlet of the second cooling duct is introduced into the first cooling duct through the connection duct and the communication port, is mixed with the air introduced through the first suction port, passes through the first cooling duct, and flows into the exhaust fan.

2. The cooking appliance of claim 1, wherein when the exhaust fan is operated, outside air is drawn into the second cooling duct through the second suction port, to thereby cool the first electrical component, and then is discharged to an outside of the cooktop through the first cooling duct and the exhaust port.

3. The cooking appliance of claim 1, wherein the connection duct is provided along a direction perpendicular to the bottom surface of the cooktop.

4. The cooking appliance of claim 1, further comprising:

a second electrical component disposed below the cooktop, wherein the second cooling duct is configured to connect with the second electrical component.

5. The cooking appliance of claim 4, wherein the bottom surface of the cooktop is provided with a receiving portion in which the second electrical component is disposed.

6. The cooking appliance of claim 4, wherein the first electrical component comprises a display configured to display a state of the cooking appliance, and the second electrical component comprises a printed circuit board on which a processor configured to control the cooking appliance is disposed.

7. The cooking appliance of claim 5, wherein when the exhaust fan is operated, outside air is drawn into the second cooling duct through the second suction port, passes the first electrical component and the second electrical component, and then is discharged to an outside of the cooktop through the first cooling duct and the exhaust port.

8. The cooking appliance of claim 1, wherein the second cooling duct is formed by the front surface of the cooktop, the top surface of the cooktop, the bottom surface of the cooktop, the first side surface and the second side surface of the cooktop.

9. The cooking appliance of claim 1, wherein a rear portion of the second cooling duct comprises two rectangular holes, and wherein the connection duct comprises a rectangular pipe corresponding to the two rectangular holes, and a partition is provided in a center of the connection duct.

10. The cooking appliance of claim 1, further comprising:

two oven exhaust ports provided at left and right sides of the exhaust port and configured to connect with the cooking chamber of the oven.

11. The cooking appliance of claim 1, comprising:

a door provided to open and close the cooking chamber; and a door air passage provided inside the door and configured to connect with the first cooling duct, wherein a lower end of the door air passage is opened to an outside of the cooking appliance.

12. The cooking appliance of claim 11, wherein when the exhaust fan is operated, outside air is drawn into the first suction port to the first cooling duct, into the second suction port to the second cooling duct, and into the lower end of the door air passage to the first cooling duct, and wherein the outside air drawn into the first suction port cools the upper portion of the oven while passing through the first cooling duct and is discharged to the outside of the cooking appliance through the exhaust port, the outside air drawn into the second suction port cools the first electrical component, is introduced into the first cooling duct, and is discharged to the outside of the cooking appliance through the exhaust port, and the outside air drawn into the lower end of the door air passage cools the door, is introduced into the first cooling duct, and then is discharged to the outside of the cooking appliance through the exhaust port.

13. A cooking appliance having a cooling system, the cooking appliance comprising:

an oven having a cooking chamber;

a cooktop to be positioned above the oven and including a front surface, a rear surface, a top surface, a bottom surface, and a first side surface and a second side surface;

a first electrical component disposed in the front surface of the cooktop;

a second electrical component disposed in an interior of the cooktop;

a first suction port disposed in an upper portion of a front surface of the oven, the first suction port being positioned below the first electrical component;

a second suction port disposed in an upper portion of a front surface of the cooktop, wherein the second suction port being positioned above the first electrical component;

a first cooling duct formed between an upper portion of the oven and the bottom surface of the cooktop and including:

a front portion configured to connect with the first suction port, and a communication port formed at a to surface of the first cooling duct;

an exhaust port disposed in a rear of the cooktop and configured to connect with a rear portion of the first cooling duct;

a second cooling duct formed above the first cooling duct, the second cooling duct formed by the cooktop itself, and including an outlet formed on the bottom surface of the cooktop:

a space provided between the bottom surface of the cooktop and the top surface of the first cooling duct;

an exhaust fan disposed at a rear portion of the oven; and a connection duct provided in the space between the bottom surface of the cooktop and the top surface of the first cooling duct so that a bottom end of the connection duct is connected to the communication port of the first cooling duct and a top end of the connection duct is connected to the outlet of the second cooling duct;

wherein the exhaust fan is configured to draw air from the first suction port toward the first cooling duct, and draw air from the second suction port toward the second cooling duct so as to cool the first electrical component, wherein the air discharged from the outlet of the second cooling duct is introduced into the first cooling duct through the connection duct and the communication port, is mixed with the air introduced through the first suction port, passes through the first cooling duct, and flows into the exhaust fan.

14. The cooking appliance of claim 13, wherein when the exhaust fan is operated, outside air is drawn into the second cooling duct through the second suction port, cools the first electrical component and the second electrical component, is introduced into the first cooling duct to be mixed with the outside air drawn into the first suction port, and then is discharged to an outside of the cooking appliance through the exhaust port.

15. The cooking appliance of claim 13, wherein the second cooling duct is formed by the front surface of the cooktop, the top surface of the cooktop, the bottom surface of the cooktop, the first side surface and the second side surface of the cooktop.

* * * * *